US009005089B2

(12) United States Patent
Huang

(10) Patent No.: US 9,005,089 B2
(45) Date of Patent: Apr. 14, 2015

(54) ABDOMINAL EXERCISE DEVICE

(71) Applicant: Jui-Ching Huang, Hsinchu (TW)

(72) Inventor: Jui-Ching Huang, Hsinchu (TW)

( * ) Notice: Subject to any disclaimer, the term of this patent is extended or adjusted under 35 U.S.C. 154(b) by 97 days.

(21) Appl. No.: 13/747,616

(22) Filed: Jan. 23, 2013

(65) Prior Publication Data

US 2014/0135188 A1 May 15, 2014

(30) Foreign Application Priority Data

Nov. 9, 2012 (TW) ..... 101221713 U
Dec. 3, 2012 (TW) ..... 101223356 U

(51) Int. Cl.

| | |
|---|---|
| ***A63B 21/00*** | (2006.01) |
| ***A63B 26/00*** | (2006.01) |
| ***A63B 71/00*** | (2006.01) |
| ***A63B 22/20*** | (2006.01) |
| ***A63B 23/02*** | (2006.01) |

(52) U.S. Cl.

CPC ..... *A63B 22/20* (2013.01); *A63B 21/1465* (2013.01); *A63B 21/1469* (2013.01); *A63B 21/1488* (2013.01); *A63B 23/0211* (2013.01); *A63B 2208/0295* (2013.01)

(58) Field of Classification Search

CPC ..... A63B 21/00185; A63B 22/20; A63B 22/201; A63B 22/203; A63B 23/0205; A63B 23/0211; A63B 2022/20; A63B 2022/201; A63B 2208/0214; A63B 21/0004; A63B 21/00101; A63B 21/068; A63B 21/1473; A63B 21/1476; A63B 21/1469; A63B 2208/0219

USPC ..... 482/92, 131, 132, 139, 142, 148

See application file for complete search history.

(56) References Cited

U.S. PATENT DOCUMENTS

| | | | | |
|---|---|---|---|---|
| 84,163 | A * | 11/1868 | Blake | 280/243 |
| 2,069,384 | A * | 2/1937 | Ogden | 482/132 |
| 4,515,362 | A * | 5/1985 | Lin | 482/51 |
| 6,254,518 | B1 * | 7/2001 | Yu | 482/140 |
| 6,264,587 | B1 * | 7/2001 | Lee | 482/132 |
| 6,338,703 | B1 * | 1/2002 | Yu | 482/132 |
| 6,409,639 | B1 * | 6/2002 | Kuo | 482/140 |
| 6,773,379 | B1 * | 8/2004 | Bing | 482/132 |
| 7,951,052 | B1 * | 5/2011 | Tang | 482/132 |
| 7,988,168 | B2 * | 8/2011 | Miroewski | 280/200 |
| 8,740,236 | B2 * | 6/2014 | Ouboter | 280/263 |
| 8,894,555 | B2 * | 11/2014 | Colledge et al. | 482/132 |
| 2002/0025894 | A1 * | 2/2002 | Fernandez | 482/140 |
| 2003/0022770 | A1 * | 1/2003 | Lee | 482/136 |
| 2003/0096680 | A1 * | 5/2003 | Nethery | 482/92 |
| 2003/0205265 | A1 * | 11/2003 | Nasco, Sr. | 135/65 |
| 2008/0203696 | A1 * | 8/2008 | Akagi | 280/238 |

(Continued)

*Primary Examiner* — Oren Ginsberg
*Assistant Examiner* — Gary D Urbiel Goldner
(74) *Attorney, Agent, or Firm* — Hershkovitz & Associates, PLLC; Abe Hershkovitz

(57) ABSTRACT

An abdominal exercise device has a kneeling pad and a roller. The kneeling pad includes a top surface and two spaced apart kneeling recesses. The kneeling recesses are formed in the top surface of the kneeling pad. The roller is positioned movably relative to the kneeling pad when in use and includes a bracket, a left handle, a right handle, a front wheel and two rear wheels. The left and right handles are attached to a middle of the bracket. The front wheel is mounted on a front of the bracket. The rear wheels are mounted on a rear of the bracket. The kneeling recesses are ergonomically designed to correspond to contours of the human knees, thereby providing a comfortable support for a user's knees. The three wheels ensure that the roller has good balanced performance such that the user can steadily operate the roller.

10 Claims, 6 Drawing Sheets

(56) References Cited

U.S. PATENT DOCUMENTS

2011/0118088 A1* 5/2011 Caya et al. ..... 482/51
2011/0275482 A1* 11/2011 Brodess et al. ..... 482/8
2012/0126507 A1* 5/2012 Wayman ..... 280/281.1
2013/0017938 A1* 1/2013 Thompson ..... 482/145

* cited by examiner

ABDOMINAL EXERCISE DEVICE

CROSS REFERENCE TO RELATED APPLICATION

This application claims priority to Taiwan patent applications No. 101221713, filed Nov. 9, 2012, and No. 101223356, filed Dec. 3, 2012, which are incorporated herein by reference in their entirety.

BACKGROUND OF THE INVENTION

1. Field of the Invention

The present invention relates to an abdominal exercise device, and more particularly to an abdominal exercise device that allows a user to exercise comfortably and steadily.

2. Description of the Related Art

An abdominal exercise device is used to train the abdominal muscles of a user. With reference to FIG. 6, a conventional abdominal exercise device comprises a kneeling pad and a roller 40. The kneeling pad includes a flat top surface. The roller 40 includes a wheel 41 with a handle 42 through the wheel 41. The roller 40 is movable relative to the kneeling pad by the rotation of the wheel 41. In use, a user kneels on the kneeling pad and holds the handle 42 to repeatedly move the roller 40 forward and backward, thereby allowing the user to exercise the abdominal muscles.

However, when the user exercises for a long duration, the user's knees may feel numbness or pain because the kneeling pad is not ergonomic. Therefore, the user is less willing to continue to exercise.

In addition, the roller 40 includes only one wheel 41 such that balanced performance of the roller 40 is poor. When the user applies unequal forces to opposite ends of the handle 42, the roller 40 is easily turned over. Accordingly, the user cannot fully concentrate on the exercise but must pay attention to both hands to keep the body balanced, thus reducing the effect of exercise on the abdominal muscles.

To overcome the shortcomings, the present invention provides an abdominal exercise device to mitigate or obviate the aforementioned problems.

SUMMARY OF THE INVENTION

The present invention provides an abdominal exercise device that allows a user to exercise comfortably and steadily.

An abdominal exercise device in accordance with the present invention comprises a kneeling pad and a roller. The kneeling pad includes a top surface and two spaced apart kneeling recesses. The kneeling recesses are formed in the top surface of the kneeling pad. The roller includes a bracket, a left handle, a right handle, a front wheel and two rear wheels. The left and right handles are attached to a middle of the bracket. The front wheel is rotatably mounted on a front of the bracket. The rear wheels are rotatably mounted on a rear of the bracket. When in use, the roller is positioned movably relative to the kneeling pad by the rotation of the front and rear wheels. A user kneels on the kneeling pad and holds the handles to repeatedly move the roller forward and backward, thereby allowing the user to exercise the abdominal muscles. The kneeling recesses are ergonomically designed to correspond to contours of the human knees, thereby providing a comfortable support for the user's knees. The user's knees do not feel numbness or pain when the user exercises for a long duration, therefore encouraging the user to continue to exercise. In addition, the three wheels ensure that the roller has good balanced performance such that the user can steadily operate the roller. The roller is not easily turned over when the user applies unequal forces to the left and right handles. The user can concentrate on the exercise and does not need to pay attention to keep the body balanced, thus enhancing the effect of exercise on the abdominal muscles.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
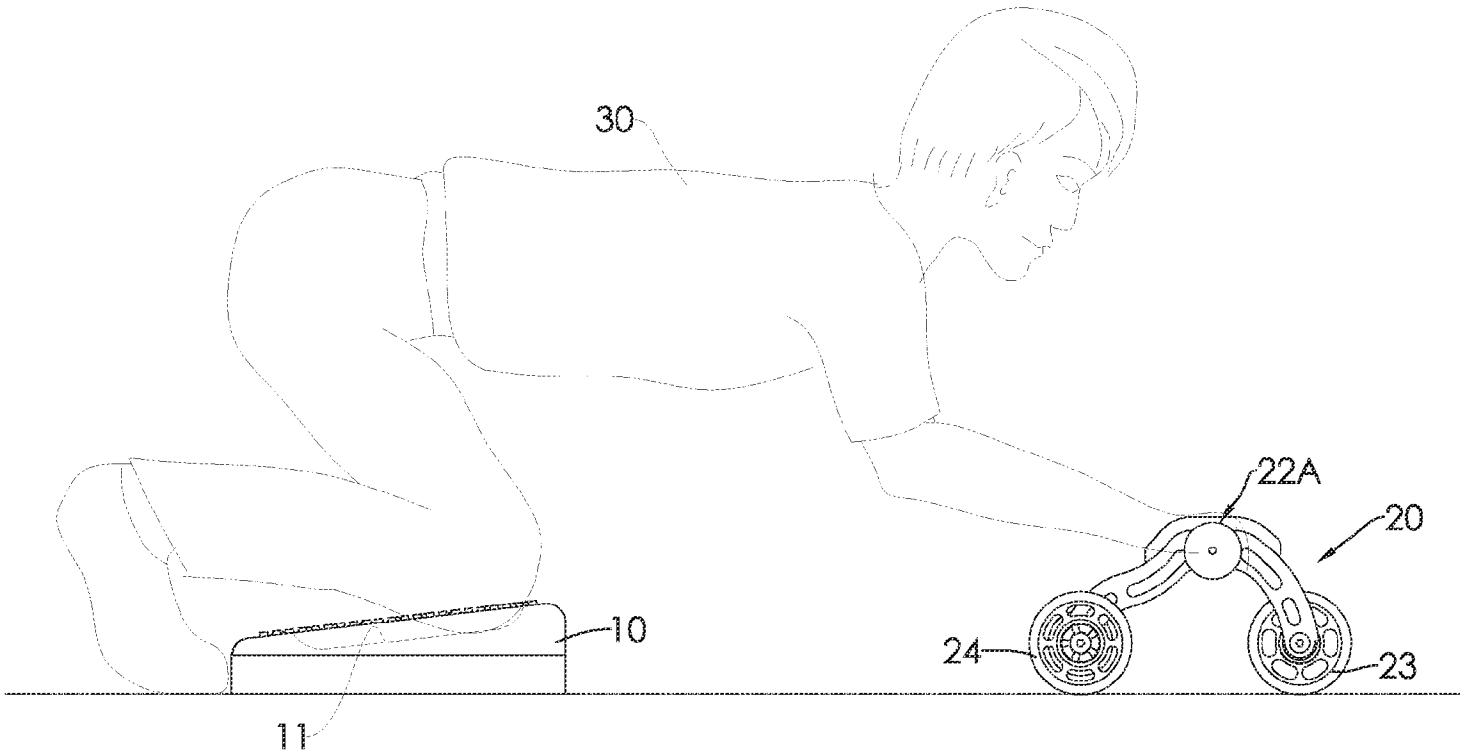
FIG. 1 is an operational side view of an abdominal exercise device in accordance with the present invention.

With reference to FIG. 1, an abdominal exercise device in accordance with the present invention comprises a kneeling pad 10 and a roller 20.

Figure 2:
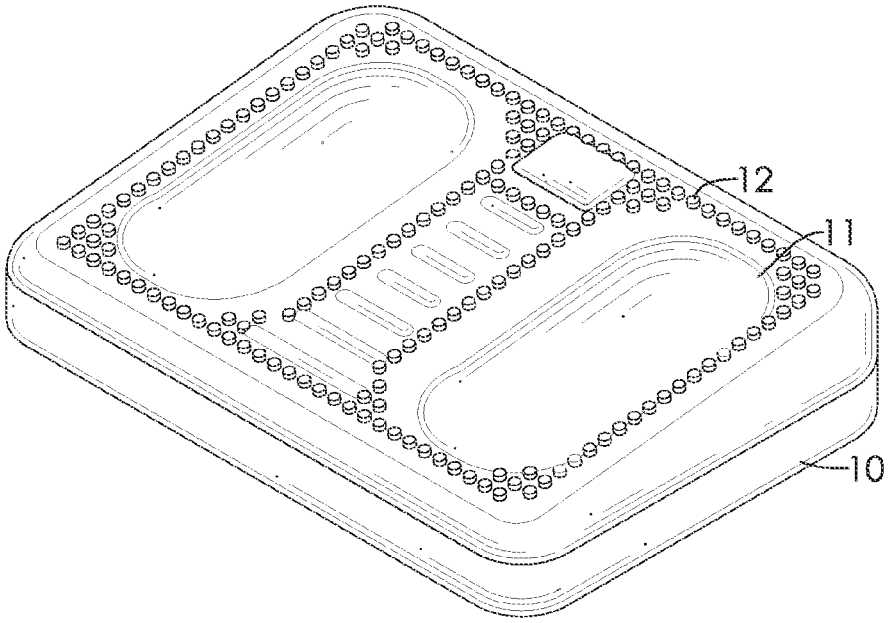
FIG. 2 is a perspective view of a kneeling pad of the abdominal exercise device in FIG. 1.

With reference to FIG. 2, the kneeling pad 10 is cuboid shaped and includes a top surface, a bottom surface, two kneeling recesses 11 and a plurality of decorative projections 12. The kneeling recesses 11 are formed in the top surface of the kneeling pad 10. The kneeling recesses 11 are elongated and are spaced apart and parallel to each other. The kneeling recesses 11 are ergonomically designed to correspond to contours of the human knees, thereby providing a comfortable support for a user's knees. The decorative projections 12 extend from portions of the top surface of the kneeling pad 10 in which the kneeling recesses 11 are not formed. Preferably, the kneeling pad 10 is made of foam plastic.

At least one receiving recess may be formed in the bottom surface of the kneeling pad 10 for storing the disassembled components of the roller 20. A bottom panel may be detachably attached to the bottom surface of the kneeling pad 10 to prevent the stored components from falling off.

Figure 3:
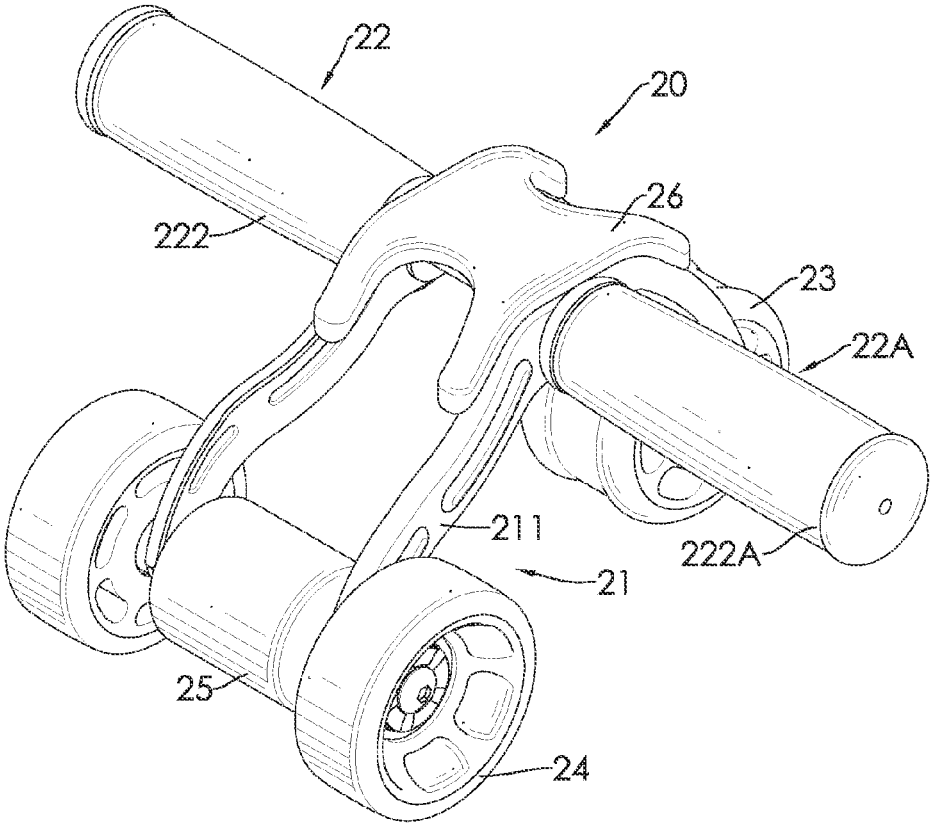
FIG. 3 is a perspective view of a roller of the abdominal exercise device in FIG. 1.
Figure 4:
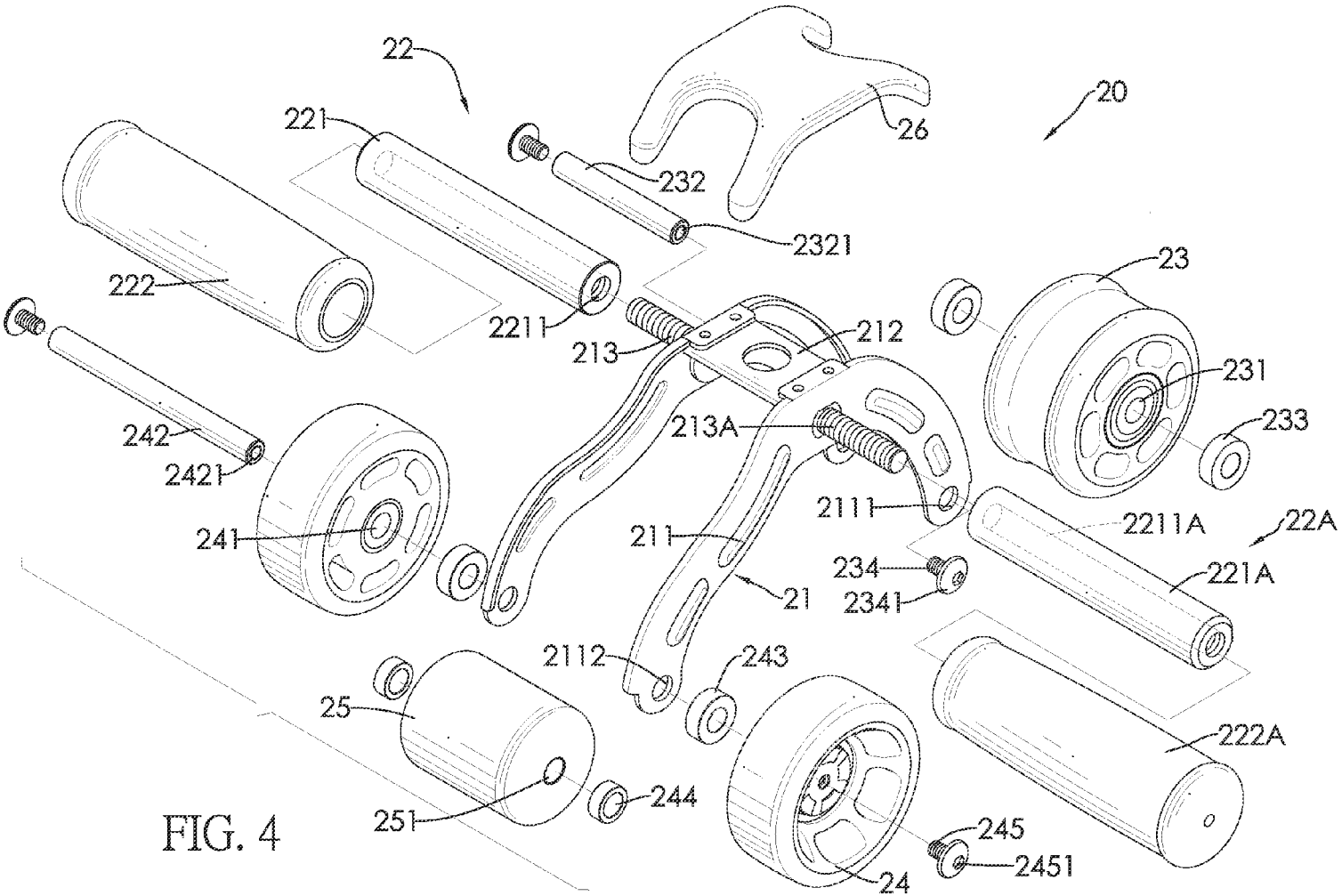
FIG. 4 is an exploded perspective view of the roller of the abdominal exercise device in FIG. 3.
Figure 5:
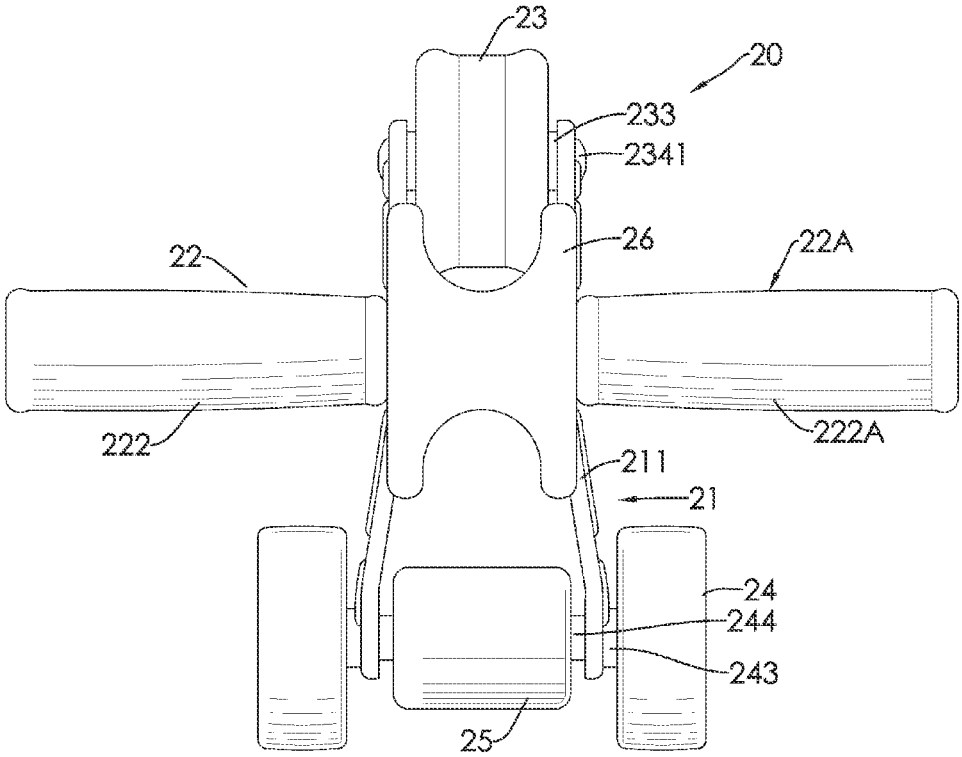
FIG. 5 is a top view of the roller of the abdominal exercise device in FIG. 3.
Figure 6:
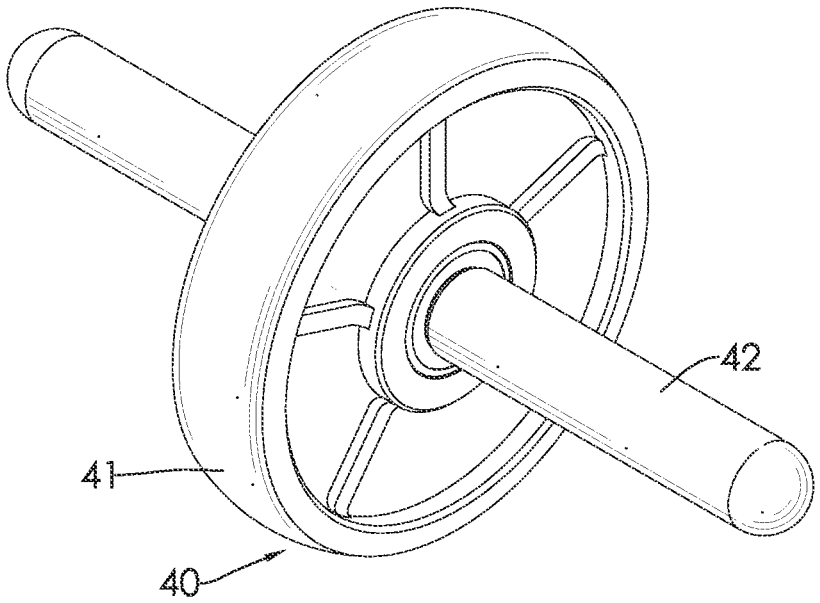
FIG. 6 PRIOR ART
FIG. 6 is a perspective view of a conventional roller in accordance with the prior art.

When in use, the roller 20 is positioned movably in front of and relative to the kneeling pad 10. With reference to FIGS. 3, 4 and 5, the roller 20 includes a bracket 21, a left handle 22, a right handle 22A, a front wheel 23, two rear wheels 24, a weight block 25 and a protective cover 26. The bracket 21 has two mounting pieces 211, a connecting piece 212, a left bolt 213 and a right bolt 213A. The mounting pieces 211 are spaced apart and parallel to each other. Each mounting piece 211 has a top, a front portion, a middle portion and a rear portion. The connecting piece 212 has two sides connected to the tops of the two mounting pieces 211. The left and right bolts 213, 213A extend leftward and rightward from the middle portions of the mounting pieces 211 respectively. The left bolt 213 is left-threaded. The right bolt 213A is right-threaded.

The left and right handles 22, 22A are symmetrically attached to the middle portions of the mounting pieces 211 of the bracket 21. Each of the left and right handles 22, 22A has a rod 221, 221A and a protective sleeve 222, 222A. The rod 221, 221A has a threaded hole 2211, 2211A therethrough. The threaded hole 2211 in the left handle 22 is a left-threaded hole. The threaded hole 2211A in the right handle 22A is a right-threaded hole. The left-threaded hole 2211 in the left handle 22 is screwed onto the left-threaded left bolt 213 of the bracket 21. The right-threaded hole 2211A in the right handle 22A is screwed onto the right-threaded right bolt 213A of the bracket 21. The left and right handles 22, 22A can be rotated in the same direction to attach to the bracket 21 because the left and right handles 22, 22A have the left-threaded and right-threaded holes 2211, 2211A for respective threaded engagement with the left-threaded left bolt 213 and right-threaded right bolt 213A of the bracket 21. Accordingly, the left and right handles 22, 22A can be rotated in the same reverse direction to detach from the bracket 21. The protective sleeve 222, 222A is mounted on the rod 221, 221A. Preferably, the protective sleeve 222, 222A is made of foam plastic.

The front wheel 23 is rotatably mounted between the front portions of the mounting pieces 211 of the bracket 21. The front portion of each mounting piece 211 has a front hole 2111 therein. The front holes 2111 of the two mounting pieces 211 are in alignment with each other. The front wheel 23 has a shaft hole 231. A front shaft 232 sequentially extends through the front hole 2111 in one of the mounting pieces 211, one of two front retaining rings 233, the shaft hole 231 in the front wheel 23, the other front retaining ring 233 and the front hole 2111 in the other mounting piece 211. The front shaft 232 has two threaded holes 2321 at its opposite ends. Two front screws 234 are threaded into the threaded holes 2321 in the front shaft 232 respectively. Each front screw 234 has a head 2341 to press against an outer surface of the mounting piece 211.

The rear wheels 24 are rotatably and symmetrically mounted on the rear portions of the mounting pieces 211 of the bracket 21. The rear portion of each mounting piece 211 has a rear hole 2112 therein. The rear holes 2112 of the two mounting pieces 211 are in alignment with each other. Each rear wheel 24 has a shaft hole 241. A rear shaft 242 sequentially extends through the shaft hole 241 in one of the rear wheels 24, one of two rear outer retaining rings 243, the rear hole 2112 in one of the mounting pieces 211, the rear hole 2112 in the other mounting piece 211, the other rear outer retaining ring 243 and the shaft hole 241 in the other rear wheel 24. The rear shaft 242 has two threaded holes 2421 at its opposite ends. Two rear screws 245 are threaded into the threaded holes 2421 in the rear shaft 242 respectively. Each rear screw 245 has a head 2451 to press against an outer surface of the rear wheel 24.

The weight block 25 is rotatably mounted between the rear portions of the mounting pieces 211 of the bracket 21. Preferably, the weight block 25 is made of marble. The weight block 25 is cylindrical and has an axial hole 251 therethrough. The rear shaft 242 extending through the shaft hole 241 in one of the rear wheels 24, one of the rear outer retaining rings 243 and the rear hole 2112 in one of the mounting pieces 211 then extends through one of two rear inner retaining rings 244, the axial hole 251 of the weight block 25 and the other rear inner retaining ring 244 and further extends through the rear hole 2112 in the other mounting piece 211, the other rear outer retaining ring 243 and the shaft hole 241 in the other rear wheel 24. Both the rear wheels 24 and the weight block 25 are mounted on the bracket 21 by the rear shaft 242.

The protective cover 26 covers the connecting piece 212 of the bracket 21. Preferably, the protective cover 26 is made of foam plastic.

With reference to FIG. 1, in use, a user 30 kneels on the kneeling pad 10 and holds the left and right handles 22, 22A to repeatedly move the roller 20 forward and backward, thereby allowing the user to exercise the abdominal muscles. The kneeling recesses 11 of the kneeling pad 10 are ergonomically designed to correspond to contours of the human knees such that the user's knees do not feel numbness or pain when the user 30 exercises for a long duration, thereby encouraging the user to continue to exercise. In addition, the three wheels 23, 24 ensure that the roller 20 has good balanced performance such that the user 30 can steadily operate the roller 20. The roller 20 is not easily turned over when the user 30 applies unequal forces to the left and right handles 22, 22A. The user 30 can concentrate on the exercise and does not need to pay attention to keep the body balanced, thus enhancing the effect of exercise on the abdominal muscles. Furthermore, the weight block 25 also prevents the roller 20 from turning over, thereby facilitating the operation of the roller 20.

Even though numerous characteristics and advantages of the present invention have been set forth in the foregoing description, together with details of the structure and features of the invention, the disclosure is illustrative only. Changes may be made in the details, especially in matters of shape, size and arrangement of parts within the principles of the invention to the full extent indicated by the broad general meaning of the terms in which the appended claims are expressed.

What is claimed is:

1. A roller for an abdominal exercise device comprising:

a bracket including two spaced apart mounting pieces, each mounting piece having a top;

a front portion having a front hole therein; and a rear portion having a rear hole therein;

a connecting piece having two sides connected to the tops of the two mounting pieces;

a left bolt;

a right bolt, the left and right bolts extending leftward and rightward from middle portions of the mounting pieces respectively;

a left handle and a right handle, the left and right handles attached to a middle of the bracket, each of the left and right handles including a threaded hole, the threaded hole in the left handle screwed onto the left bolt of the bracket, and the threaded hole in the right handle screwed onto the right bolt of the bracket;

a front wheel rotatably mounted on a front of the bracket and including a shaft hole; and a front shaft sequentially extending through the front hole in one of the mounting pieces, the shaft hole in the front wheel, and the front hole in the other mounting piece, the front shaft having two threaded holes at its opposite ends;

two front screws threaded into the two threaded holes in the front shaft respectively, and each front screw having a head to press against an outer surface of the mounting piece;

two rear wheels rotatably mounted on a rear of the bracket, each rear wheel including a shaft hole; and a rear shaft sequentially extending through the shaft hole in one of the rear wheels, the rear hole in one of the mounting pieces, the rear hole in the other mounting piece, and the shaft hole in the other rear wheel, the rear shaft having two threaded holes at its opposite ends; and two rear screws threaded into the two threaded holes in the rear shaft respectively, and each rear screw having a head to press against an outer surface of the rear wheel.

2. The roller as claimed in claim 1, wherein the left bolt of the bracket is left-threaded, and the right bolt of the bracket is right-threaded; and the threaded hole in the left handle is a left-threaded hole, the threaded hole in the right handle is a right-threaded hole, the left-threaded hole in the left handle is screwed onto the left-threaded left bolt of the bracket, and the right-threaded hole in the right handle is screwed onto the right-threaded right bolt of the bracket.

3. The roller as claimed in claim 2, wherein each of the left and right handles includes a rod through which the threaded hole extends; and a protective sleeve mounted on the rod.

4. The roller as claimed in claim 1 further comprising a weight block mounted on the rear of the bracket.

5. The roller as claimed in claim 2 further comprising a weight block mounted on the rear of the bracket.

6. The roller as claimed in claim 3 further comprising a weight block mounted on the rear of the bracket.

7. The roller as claimed in claim 5, wherein the weight block includes an axial hole therethrough, and the rear shaft extending through the shaft hole in one of the rear wheels and the rear hole in one of the mounting pieces then extends through the axial hole of the weight block and further extends through the rear hole in the other mounting piece and the shaft hole in the other rear wheel.

8. The roller as claimed in claim 6, wherein the weight block includes an axial hole therethrough, and the rear shaft extending through the shaft hole in one of the rear wheels and the rear hole in one of the mounting pieces then extends through the axial hole of the weight block and further extends through the rear hole in the other mounting piece and the shaft hole in the other rear wheel.

9. The roller as claimed in claim 7 further comprising a protective cover covering the connecting piece of the bracket.

10. The roller as claimed in claim 8 further comprising a protective cover covering the connecting piece of the bracket.

* * * * *